United States Patent [19]

Hynes

[11] Patent Number: 4,911,244

[45] Date of Patent: Mar. 27, 1990

[54] MARINE CASING SUSPENSION APPARATUS

[75] Inventor: Joseph H. Hynes, Houston, Tex.

[73] Assignee: Cameron Iron Works USA, Inc., Houston, Tex.

[21] Appl. No.: 373,584

[22] Filed: Jun. 30, 1989

[51] Int. Cl.[4] ..... E21B 33/043

[52] U.S. Cl. ..... 166/368; 166/123; 166/208; 166/337; 166/348; 166/360; 175/7; 285/3; 285/18; 285/25; 285/137.2; 285/140; 285/141; 285/142; 285/321

[58] Field of Search ..... 166/337, 368, 123, 360, 166/348, 208; 285/18, 25, 137.2, 141, 321, 140, 142, 3; 175/7; 405/224

[56] References Cited

U.S. PATENT DOCUMENTS

| | | | |
|---|---|---|---|
| 3,273,646 | 9/1966 | Walker | 285/140 |
| 3,421,580 | 1/1969 | Fowler et al. | 166/368 |
| 3,497,243 | 2/1970 | Gruller et al. | 285/141 |
| 3,592,489 | 7/1971 | Baugh et al. | 285/18 |
| 3,847,215 | 1/1974 | Herd | 166/337 |
| 4,295,665 | 10/1981 | Pierce | 285/3 |
| 4,355,825 | 10/1982 | Leicht | 285/140 |
| 4,550,782 | 11/1985 | Lawson | 285/141 |
| 4,691,780 | 9/1987 | Galle, Jr. et al. | 166/348 |
| 4,757,860 | 7/1988 | Reimert | 166/208 |
| 4,773,477 | 9/1988 | Putch | 166/208 |

FOREIGN PATENT DOCUMENTS

| | | | |
|---|---|---|---|
| 0261909 | 3/1988 | European Pat. Off. | 166/208 |

OTHER PUBLICATIONS

P. 1497, Composite Catalogue, World Oil Publishing, 88–89 Edition, vol. 2.

*Primary Examiner*—Jerome W. Massie
*Assistant Examiner*—Ezio DiSante

[57] ABSTRACT

An improved wellhead casing hanger for suspension of successive casing strings with particularly small annular spacings having an adapter sleeve of double wall construction which is utilized with a load bearing shoulder on the inside of the inner member for receiving a conventional expanding type hanger, with the annulus between the inner and outer walls providing an improved fluid return path without restricting the bore of the sleeve, packoff for sealing the annulus at the appropriate time and an installation tool.

10 Claims, 5 Drawing Sheets

MARINE CASING SUSPENSION APPARATUS

BACKGROUND

As exploration in the oil and gas industry has expanded, increased safety and environmental concerns have caused oil and gas exploration and drilling contractors to require an intermediate protection casing to be used between the surface casing and the conventional intermediate casing. Casing hangers of this type must provide sufficient weight carrying capacity with their support mechanisms while maintaining a pressure capacity comparable to that of the casing being suspended. Typically, hangers have failed in one way or another to meet these criteria. Often their use requires that the bore of the previous casing hanger be unduly restricted if a mandrel shoulder type hanger is used while the use of an expanding type hanger often requires undue restrictions in the annulus between the protection and surface casings, causing problems during cementing and circulating operations.

This invention is for an improved wellhead casing hanger particularly suited for use in situations where the annular spacing between successive casing strings is inordinately small. The present invention provides a unique wellhead hanger system which provides improved weight capacity, increased flow return area and full bore access to the protection casing below the hanger.

Prior casing hangers used in situations where the annular spacing between successive casing strings is inordinately small include two types of devices. The first type of these is disclosed by U.S. Pat. No. 3,421,580 which shows an expanding type hanger to suspend the protection casing. The expanding type hanger lands in a specially profiled circumferential groove in the surface casing hanger with flow return passages formed in the wall of the surface casing hanger. A similar structure is found in U.S. Pat. No. 3,847,215 wherein the expanding type hanger is used to suspend multiple tubing strings with flow return passages formed in the surface casing hanger in which it is landed.

The second type of casing hanger is shown in U.S. Pat. No. 3,592,489 wherein a shouldered or mandrel type hanger lands on a circumferential seat or shoulder protruding from the surface casing hanger's bore. Flow return passages are formed in the surface hanger's wall with the protruding shoulder split into a plurality of arcuate segments which are radially movable by piston means. A similar type of hanger is manufactured by FMC Corporation and is shown in the Composite Catalogue published by World Oil Publishing, '88–'89 Edition, Volume 2, p. 1497. The FMC structure differs from the structure of U.S. Pat. No. 3,592,489 by having the protruding shoulder an integral part of the wellhead housing.

SUMMARY

The present invention provides an improved wellhead casing hanger for suspension of concentric casing strings with small annular spacings. The improved wellhead casing hanger has an outer adapter sleeve installed in the surface casing string, an expanding type hanger for suspending the protection casing and a means for sealing the annulus therebetween. The adapter sleeve is composed of a pair of concentric cylindrical members with the inner member providing the mating shoulder or seat on which to land the expanding type hanger and the outer member providing pressure integrity and increased flow return area. The inner and outer cylindrical members are sealingly connected to one another and installed in the surface casing string at the appropriate point. There is an annular gap between the lower extremity of the inner and outer members allowing flow returns into the annulus therebetween. Flow return passages formed in the inner member adjacent the engagement point with the outer member complete the flow return path around the protection casing hanger. The expanding type hanger is landed on the shoulder provided in the inside wall of the adapter sleeve. A combination casing and packoff installation too is then used to install the annulus seal means.

An object of the present invention is to provide an improved wellhead casing hanger which provides increased flow return area, pressure capacity and weight supporting capacity.

Another object is to provide an improved wellhead casing hanger which allows the protection casing to be suspended at any convenient point in the surface casing string.

A further object is to provide an improved wellhead casing hanger for protection casing which will pass through a wellhead without requiring the removal of the nominal bore protector.

BRIEF DESCRIPTION OF THE DRAWINGS

These and other objects and advantages of the present invention are set forth below and further made clear by reference to the drawings wherein.

DESCRIPTION OF THE PREFERRED EMBODIMENTS

Figure 1:
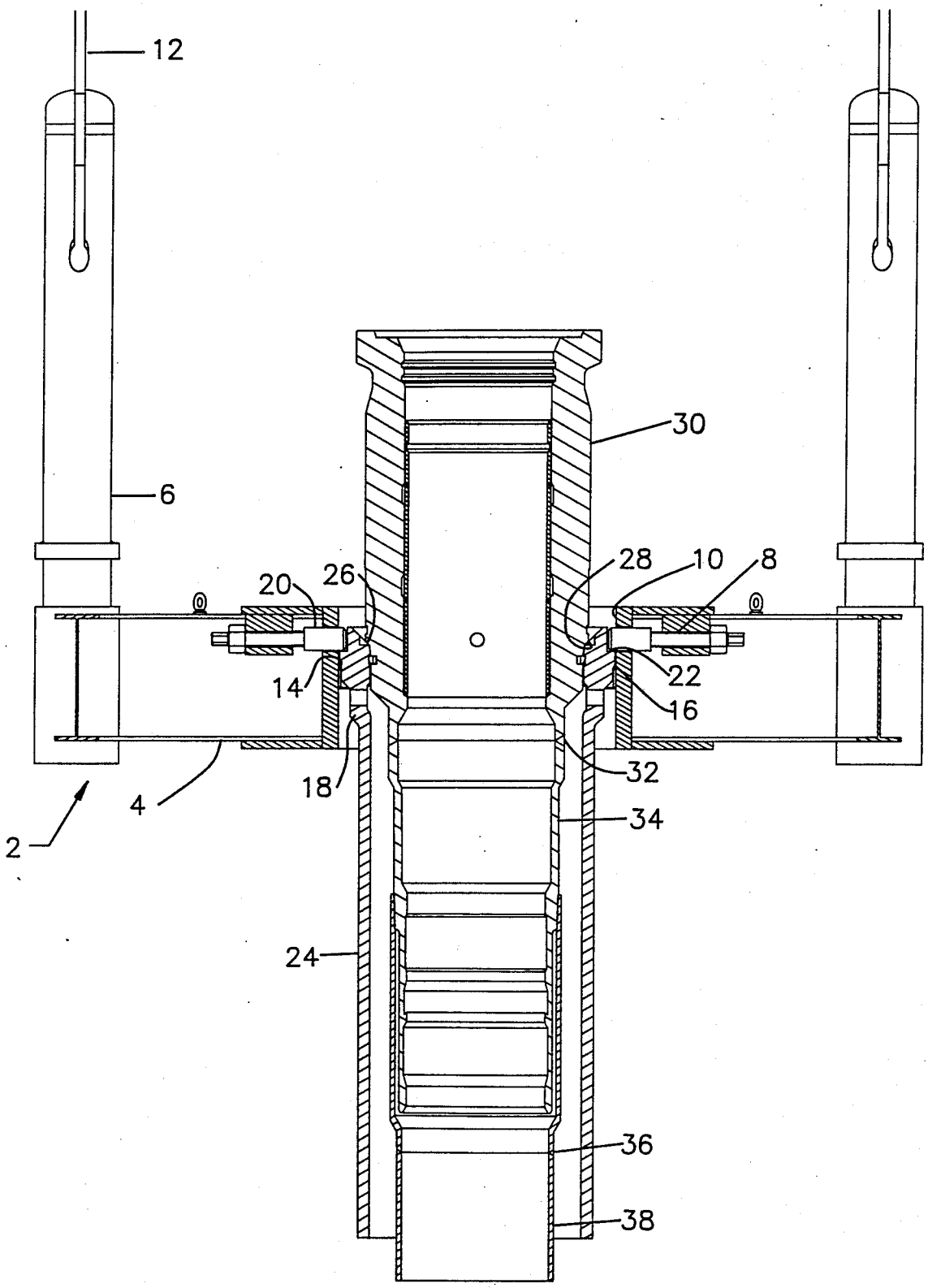
FIG. 1 is an elevation view, partly in section, of a wellhead and guide base with the adapter sleeve of the present invention installed at the lower end of the wellhead.

With reference to FIG. 1, guidance means 2 is located on the sea floor and includes permanent guide base 4 with guide posts 6 attached thereto and latching means 8 circumferentially spaced about central bore 10. Guidance means 2 in the form of wire cables 12 are attached to each guide post 6 and extend to the ocean surface for attachment to conventional tensioning means, not shown. Within central bore 10 is located landing shoulder 14 for receiving a mating shoulder 16 on conductor housing !8. When conductor housing 18 is landed on shoulder 16, pin 20 of latching means 8 engages upwardly facing shoulder 22 and thereby locks housing 18 from vertical movement with respect to guide base 4. Conductor pipe 24, typically 30" in diameter, attaches to conductor housing 18 by suitable means, such as welding (not shown).

Conductor housing 18 has inside upper shoulder 26, tapering inwardly and downwardly, upon which mating tapered shoulder 28 of wellhead 30 rests. Attached to wellhead 30 by suitable means, such as butt weld 32 is adapter sleeve 34 of the present invention which will be more fully described below. Connected to adapter sleeve 34 by suitable means, such as butt weld 36, is surface casing 38, typically 20" in diameter.

Figure 2:
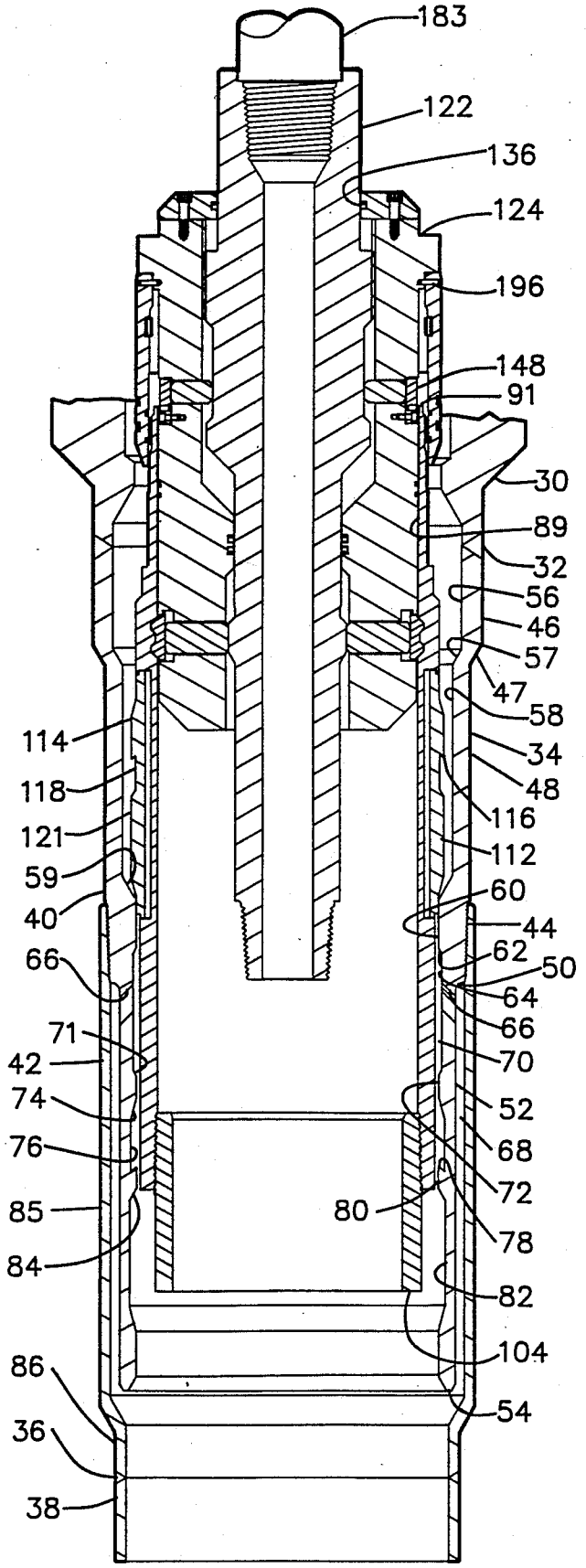
FIG. 2 is a sectional view showing the improved protection string casing hanger of the present invention being lowered into the adapter sleeve.

Referring now to FIG. 2, the lowermost portion of wellhead 30 is shown with adapter sleeve 34 connected thereto. Adapter sleeve 34 includes generally cylindrical inner member 40 and outer member 42. Members 40 and 42 are sealingly and structurally connected by casing threads 44. Enlarged portion 46 of inner member 40 abuts wellhead 30 and is connected thereto by weld 32. Outer surface 47 tapers inwardly and downwardly to central section 48 which extends substantially axially and terminates with external tapered casing thread 44 formed thereon. Radius 50 connects thread 44 with reduced outer portion 52 which extends axially to lower end 54 of inner member 40. Inside surface 56 extends substantially axially and is connected to surface 58 by conical surface 57, which tapers inwardly and downwardly. The lower end of inside surface 58 is connected to bore 60 by beveled surface 59 which tapers downwardly and inwardly. Bore 60 terminates at tapered surface 62 which tapers downwardly and outwardly to intersect surface 64 which extends downwardly. Flow return passages 66 extend through sleeve 34 and obliquely intersect reduced outer portion 52 and surface 64, thereby allowing fluid returns to pass from annulus 68 to annulus 70. Surface 64 is connected to guidance surface 72 by conical surface 71, which tapers downwardly and inwardly. Guidance surface 72 is connected to clearance surface 76 by conical surface 74, which tapers downwardly and outwardly. Clearance surface 76 extends axially downward to load surface or shoulder 78, which tapers upwardly and inwardly to restricted bore 80. Bore 80 extends slightly downward and is connected to lower guidance portion 82 of inner member 40 by downwardly and outwardly tapering conical surface 84.

Outer member 42 is connected to inner member 40 by casing thread 44 and central portion 85 depends therefrom to lower portion 86 of reduced diameter. Surface 52 of outer member 42 and the interior of central portion 85 define annulus 68 therebetween. Fluid returns in the annulus between the surface and protection casing strings flow upwardly into annulus 68, and through flow return passages 66 to annulus 70. The reduced diameter of lower portion 86 allows attachment of surface casing 38 by conventional means, such as welding 36 or threading.

Figure 3:
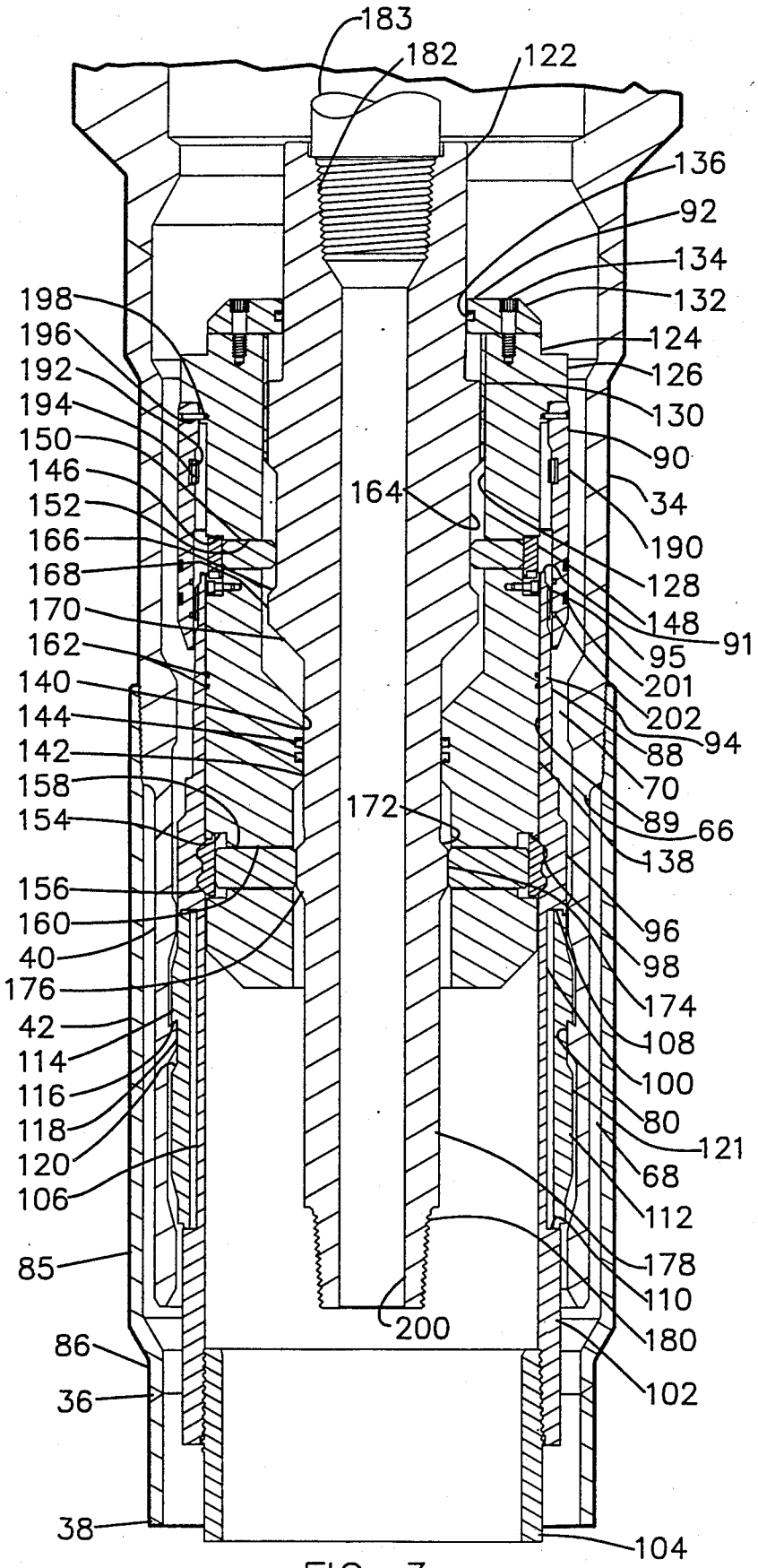
FIG. 3 is a sectional view showing the improved protection string casing hanger landed in the adapter sleeve.

Referring now to FIG. 3, protection string casing hanger 88 and packoff 90 have been lowered into position by combination tool 92 into adapter sleeve 34. Protection string casing hanger 88 is a generally tubular member with upper portion 94 having external latch threads 95 to receive packoff 90. Substantially thicker central portion 96 has internal grooves 98 and external groove 100 disposed axially below grooves 98. Lower portion 102 is threaded internally to receive the protection casing 104. External groove 100 is further defined by cylindrical surface 106 with upper and lower end surfaces 108 and 110, respectively. Sitting within groove 100 is load ring 112, restrained from axial movement with respect to hanger 88 by end surfaces 108 and 110.

Load ring 112 is a generally split ring with outer surface 114 having a keyed profile to allow engagement with inner member 40 of adapter sleeve 34. The keyed profile consists of outer surface 114 interrupted by proximal bearing surface 116, tapering inwardly and upwardly to profile surface 118, which closely fits adjacent restricted bore 80. Profile surface 118 extends axially downward to conical surface 120, which tapers outwardly and downwardly to outer surface 121. Load ring 112 has a circumferential section removed thus allowing load ring 112 to contract radially to pass diametrical restrictions and then expand to its relaxed i.e. load bearing diameter.

Combination tool 92 is best seen in FIG. 3 with protection string casing hanger 88 in its landed position and packoff 90 held in a retracted position. Combination tool 92 includes inner body 122 in close fitting and threaded engagement with outer body 124. Outer body 124 is a generally tubular member with upper portion 126 having bore 128 with internal threads 130 which structurally connect inner body 122 and outer body 124. Top plate 132 is attached to upper end of upper portion 126 by suitable means such as cap screws 134 and is in sealing engagement with inner body 122 by seal means 136. Substantially thicker lower portion 138 of outer body 124 has reduced bore 140 which slidingly receives medial portion 142 of inner body 122 and is sealed thereto by sealing means 144.

Intermediately located on outer body 124 is external groove 146 with radially inwardly biased split ring 148 carried therein. Radial movement of split ring 148 is accomplished by a plurality of pins 150 moving in radial bores 152 in a manner more fully explained below. Located at the lower end of outer body 124 is a second groove 154 carrying a radially inwardly biased split ring 156. Split ring 156 has an external profile which allows engagement with grooves 98 when moved radially outwardly by a plurality of pins 158 moving in radial bores 160 as explained hereinafter. Also intermediately located on the outside of outer body 124 are seal means 162, for use during pressure testing.

Inner body 122 of combination tool 92 is a generally tubular member axially movable within outer body 124 by threads 130. Below threads 130 is reduced portion 164 of inner body 122 which allows pins 150 to retract radially inward by the action of inwardly biased split ring 148. Reduced portion 164 is connected to enlarged portion 168 by conical camming surface 166. Enlarged portion 168 is connected to medial portion 142 by conical surface 170 tapering inwardly and downwardly. Medial portion 142 extends axially to conical camming surface 172, which tapers outwardly and downwardly to support portion 174. Support portion 174 is connected to lower portion 178 by conical surface 176. Lower portion 178 terminates with drill pipe thread 180. The upper end of inner body 122 contains drill pipe thread 182 for connection of the drill pipe running string 183.

Packoff 90 is a generally annular member consisting of body 190 with internal groove 192 located proximate the upper end thereof. Split latching ring 194 sits in groove 192 and is biased radially inwardly and threaded internally to mate with external threads 95 of protection string casing hanger 88. Packoff 90 is retained on combination tool 92 in its retracted (running) position by a plurality of frangible members, such as shear pins 196 which are retained in a plurality of radially directed blind holes 198 in outer body 124. The lower end of body 190 has external and internal seal means, 201 and 202, respectively, which function as hereinafter described.

A typical sequence of operations utilizing the improved protection string casing hanger 88 and adapter sleeve 34 begins with the structure in FIG. 1. Adapter sleeve 34 has been attached to wellhead 30 by suitable means, such as weld 32, with surface casing 38 similarly attached to the lower end of sleeve 34 by weld 36. This assembly is lowered into the position shown in FIG. 1, with shoulder 28 landed on shoulder 26.

After the hole for the protection casing string has been drilled, casing hanger 88, packoff 90, combination tool 92 and protection string 104 are assembled in the following manner. Packoff 90 is positioned on tool 92 and pinned in place with shear pins 196. Inner body 122 is rotated until enlarged portion 168 forces pins 150 radially outward, camming split ring 148 to its maximum diameter so that as combination tool 92 is lowered into casing hanger 88 split ring 148 will contact end surface 91 of hanger 88. Inner body 122 is rotated downward while outer body 124 is held stationary by chain tongs, allowing support portion 174 to force pins 158 radially outward, camming split ring 156 into engagement with grooves 98 of protection string hanger 88. Simultaneously, enlarged portion 168 is moved below pins 150, allowing inwardly biased split ring 148 to contract to a diameter sufficiently small to fit inside bore 89 of hanger 88. At this point, the combination tool 92 is structurally connected to the hanger 88 and packoff 90 and the protection casing string 104 can be lowered, along with hanger 88 and packoff 90 into adapter sleeve 34.

As the tool 92 and hanger 88 each the position shown in FIG. 2, outer surface 114 of load ring 112 contacts beveled surface 59 to cam load ring 112 inwardly to its fully contracted position. Further lowering of the protection casing string 104 allows profile surface 118 to come into registry with restricted bore 80, thereby allowing load ring 112 to expand to its maximum diameter. At this point, bearing surface 116 will contact load surface 78, and the weight of the protection casing string 104 will be transferred to the adapter sleeve 34, as best seen in FIG. 3.

Figure 4:
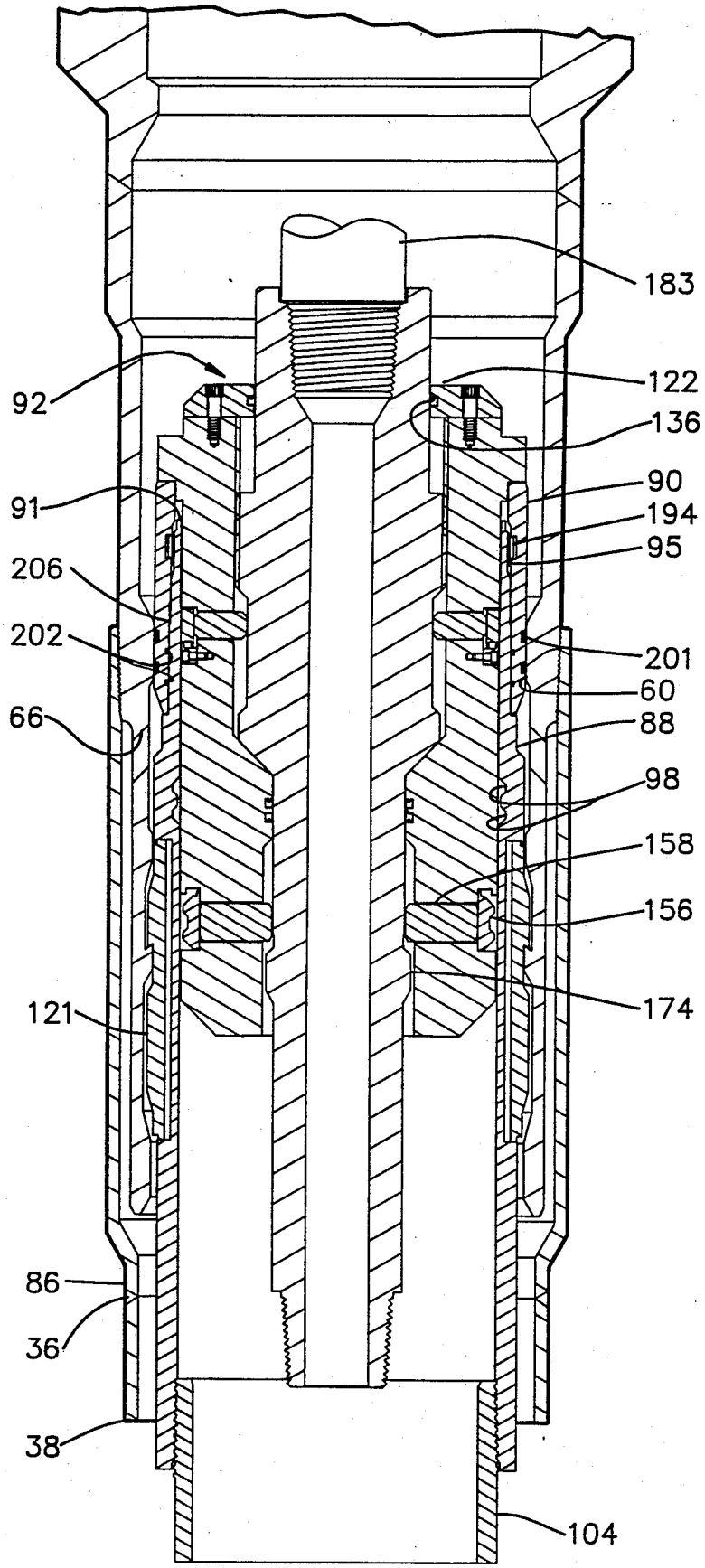
FIG. 4 is a sectional view showing the improved protection string casing hanger with the annulus seal means and its installation tool therein.

Circulating and cementing operations are next performed through bore 200 of tool 92 with flow returns passing into annulus 68, through flow return passages 66 into annulus 70 and hence to the surface. The packoff 90, as best seen in FIG. 4 is lowered into position by further rotation of inner body 122 of tool 92. This downward movement of inner body 122 moves support portion 174 from behind pins 158, allowing inwardly biased split ring 156 to retract from grooves 98, thus allowing tool 92 to move to the position shown in FIG. 4. In this position, inwardly biased split latching ring 194 engages threads 95 by first expanding and then contracting around threads 95 responsive to the downward movement, thereby locking packoff 90 to hanger 88 and sealing means 201 seals against bore 60 and sealing means 202 seals against surface 206 of hanger 88. The packoff 90 is then tested by applying suitable test pressure. If the test is unsuccessful and it is desired to retrieve packoff 90, rotation of tool 92 will cause split latching ring 194 to release from hanger thread 95, allowing retrieval of packoff 90 and combination tool 92. If the pressure test is successful, combination tool 92 is pulled upwardly, causing shear pins 196 to shear, allowing tool 92 to be removed from hanger 88 and retrieved to the surface.

Figure 5:
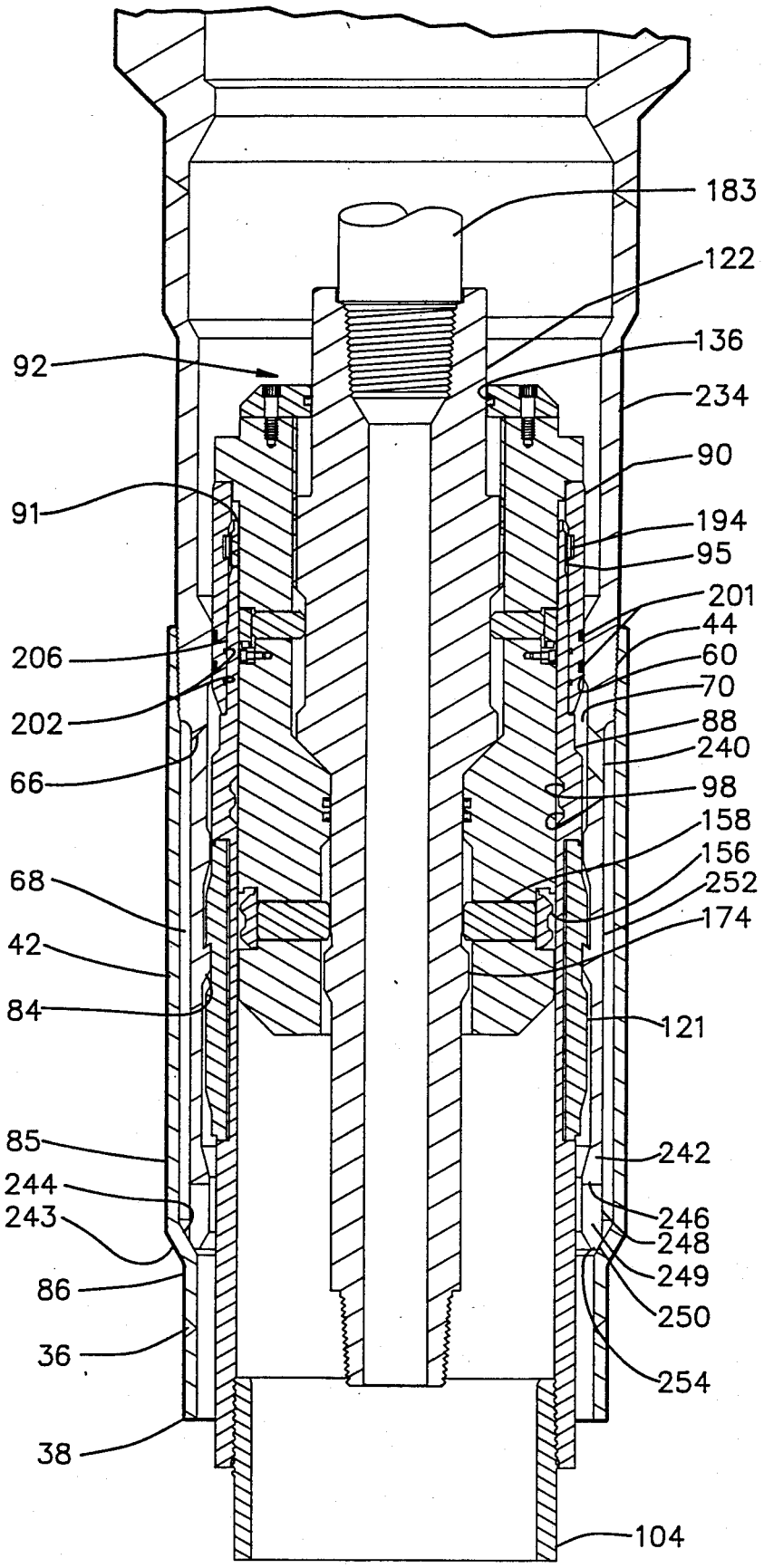
FIG. 5 is a sectional view showing an alternate embodiment of the improved protection string casing hanger with the annulus seal means and its installation tool therein.

An alternate embodiment of the improved wellhead is depicted in FIG. 5. This alternate embodiment differs from the first embodiment only in the modification of adapter sleeve 234. Adapter sleeve 234 is composed of generally cylindrical modified inner member 240 and outer member 42. Members 240 and 42 are sealingly and structurally connected by casing threads 44 as described above. Inner member 240 is identical to inner member 40 of the preferred embodiment except for the lower guidance portion 242. Lower guidance portion 242 extends axially downward with outer surface 248 connected to end surface 254 by conical surface 250, which tapers downwardly and inwardly.

Central portion 85 of outer member 42 terminates with inwardly and downwardly tapering conical section 243 which connects to lower portion 86 of reduced diameter. Conical section 243 has inside conical surface 244 against which conical surface 250 engages when outer member 42 and inner member 240 are connected by casing thread 44. A plurality of flow return slots 249 are circumferentially equally spaced in lower guidance potion 242 and extend from end surface 254 axially upward to upper slot surface 246. Outer surface 252 of inner member 240 and the interior of central portion 85 define annulus 68 therebetween. Fluid returns in the annulus between the surface and protection casing strings flow upwardly into annulus 68 through flow return slots 249 and thence through flow return passages 66 to annulus 70.

In all other respects the alternate embodiment of FIG. 5 functions the same as the preferred embodiment of FIGS. 2–4. The same protection string casing hanger 88 is utilized with the modified adapter sleeve 234 as described before. Combination tool 92 is used in the same manner described above to run the casing hanger 88 and set the packoff 90.

What is claimed is:

1. A marine casing suspension apparatus for a marine wellhead having an internal landing shoulder comprising an adapter sleeve having an upper tubular portion and a lower portion comprising an inner tubular member and an outer tubular member concentric therewith and an annular space therebetween, casing support means on the interior of said inner tubular member, means for supporting said adapter sleeve from said wellhead, and flow return passages through said inner tubular member to provide for flow return of fluids from the annular space between the inner and outer tubular members to the interior of said upper tubular portion of said adapter sleeve.

2. A marine casing suspension apparatus according to claim 1 including a casing hanger having an external groove and a split support ring mounted therein, said casing support means including an upwardly facing shoulder on the interior of said inner tubular member, said split support ring including a downwardly facing shoulder for coaction with said casing support shoulder, said split support ring being biased outwardly for moving into engagement with its downwardly facing shoulder on said casing support shoulder.

3. A marine casing suspension apparatus according to claim 2 including a contour on the exterior of said split support ring, a contour on the interior of said inner tubular member coacting with the contour on said split ring to retain said split ring in said groove in said casing hanger during movement of the casing hanger through said adapter sleeve until said shoulders are in supporting engagement with each other.

4. A marine casing suspension apparatus according to claim 2 including annulus sealing means for sealing across the annulus between the interior of said upper tubular portion of said adapter sleeve and the exterior of said casing hanger.

5. A marine casing suspension apparatus according to claim 1 or 2 wherein said inner and outer tubular members of said lower portion of said adapter sleeve are sealingly and structurally connected at the upper end of said annular space therebetween.

6. A marine casing suspension apparatus according to claim 1 including a casing hanger having an external downwardly facing shoulder, and said casing support means including an upwardly facing shoulder for coaction with said external downwardly facing shoulder of said casing hanger.

7. An improved casing suspension apparatus for use in a surface casing string comprising an adapter sleeve having means for structural and sealing connection with a surface casing string and having an upper tubular portion and a lower portion comprising an inner tubular member and an outer tubular member concentric therewith and an annular space therebetween, casing support means on the interior of said inner tubular member, and flow return passages through said inner tubular member to provide for flow return of fluids from the annular space between the inner and outer tubular members to the interior of said upper tubular portion of said adapter sleeve.

8. An improved casing suspension apparatus according to claim 7 including a casing hanger having an external groove and a split support ring mounted therein, said casing support means including an upwardly facing shoulder on the interior of said inner tubular member, said split support ring including a downwardly facing shoulder for coaction with said casing support shoulder, said split support ring being biased outwardly for moving into engagement with its downwardly facing shoulder on said casing support shoulder.

9. An improved casing suspension apparatus according to claim 8 including annulus sealing means for sealing across the annulus between the interior of said upper tubular portion of said adapter sleeve and the exterior of said casing hanger.

10. An improved casing suspension apparatus according to claim 8 including a contour on the exterior of said split support ring, a contour on the interior of said inner tubular member coacting with the contour on said split support ring to retain said split support ring in said groove in said casing hanger during movement of the casing hanger through said adapter sleeve until said shoulders are in supporting engagement with each other.

* * * * *